US008940136B2

(12) United States Patent
Kim et al.

(10) Patent No.: US 8,940,136 B2
(45) Date of Patent: Jan. 27, 2015

(54) COKING PLANT WITH FLUE GAS RECIRCULATION

(75) Inventors: Ronald Kim, Essen (DE); Rainer Worberg, Bottrop (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 521 days.

(21) Appl. No.: 13/257,837

(22) PCT Filed: Feb. 1, 2010

(86) PCT No.: PCT/EP2010/000581

§ 371 (c)(1),
(2), (4) Date: Sep. 20, 2011

(87) PCT Pub. No.: WO2010/112100

PCT Pub. Date: Oct. 7, 2010

(65) Prior Publication Data

US 2012/0006668 A1 Jan. 12, 2012

(30) Foreign Application Priority Data

Apr. 1, 2009 (DE) ..... 10 2009 015 270

(51) Int. Cl.

| | |
|---|---|
| ***C10B 15/02*** | (2006.01) |
| ***C10B 21/18*** | (2006.01) |
| ***F23C 5/08*** | (2006.01) |
| ***F23C 9/00*** | (2006.01) |

(52) U.S. Cl.

CPC ..... *C10B 21/18* (2013.01); *C10B 15/02* (2013.01); *F23C 5/08* (2013.01); *F23C 9/003* (2013.01)

USPC ..... 201/15; 202/135; 202/145

(58) Field of Classification Search

CPC ..... C01B 15/02; C01B 21/18; F23C 5/08; F23C 9/003

USPC ..... 201/15, 27; 202/135, 138, 145

See application file for complete search history.

(56) References Cited

U.S. PATENT DOCUMENTS

| | | | | |
|---|---|---|---|---|
| 5,318,671 | A | 6/1994 | Pruitt | |
| 6,596,128 | B2 * | 7/2003 | Westbrook | 202/113 |

FOREIGN PATENT DOCUMENTS

| | | | |
|---|---|---|---|
| CN | 1358822 | A | 7/2002 |
| CN | 2500682 | Y | 7/2002 |
| CN | 2505478 | Y | 8/2002 |
| DE | 3911295 | A1 | 11/1989 |
| DE | 102005015301 | A1 | 10/2006 |
| JP | 10265778 | A | 10/1998 |
| WO | 9014408 | A1 | 11/1990 |

OTHER PUBLICATIONS

International Search Report for PCT/EP2010/000581, English translation attached to original, Both completed by the European Patent Office on Jun. 24, 2010, All together 6 Pages.

* cited by examiner

*Primary Examiner* — Jill Warden
*Assistant Examiner* — Joye L Woodard
(74) *Attorney, Agent, or Firm* — Brooks Kushman P.C.

(57) ABSTRACT

Improvement in carbonization in a carbonization furnace and simultaneous reduction in $NO_x$ emissions is achieved by recirculation of waste gas from a coking oven back to the oven chamber, the downcomers, or the sole channel system.

6 Claims, 6 Drawing Sheets

1B-1B

COKING PLANT WITH FLUE GAS RECIRCULATION

CROSS-REFERENCE TO RELATED APPLICATION

This application is the U.S. National Phase of PCT Appln. No. PCT/EP2010/000581 filed Feb. 1, 2010 which claims priority to German application DE 10 2009 015 270.9 filed Apr. 1, 2009.

BACKGROUND OF THE INVENTION

1. Field of the Invention

The invention relates to a carbonization plant designed and built according to the Non-Recovery Process or Heat Recovery Process for the production of coke from coal.

2. Description of the Related Art

In the past years, a great deal of improvements had therefore been proposed to homogenize the feed of primary and secondary air in the upper and lower oven in order to ensure a planar heating of the coal/coke charge from top to bottom. It is thereby possible to shorten the operating time required for a complete carbonization of the coal charge and to increase economic efficiency. Nevertheless, present solutions just represent an approximation to a planar heating because primary air in the upper oven and secondary air in the lower oven can always be supplied only spot-wise via the oven ground area.

A high throughput rate is particularly important to achieve economic efficiency of a carbonization plant according to the Non-Recovery Process or Heat Recovery Process, hereinafter briefly referred to as NR/HR. It is primarily due to the fact that a prolonged operating time, i.e. less economic efficiency, is always to be assumed for this technology since compared with the conventional horizontal chamber technology the release of combustion gas can only be slightly influenced. The velocity of this carbonization technology can only be influenced by an even supply of air to the process at several stages to optimize combustion.

In the past years, a great deal of improvements had therefore been proposed to homogenize the feed of primary and secondary air in the upper and lower oven in order to ensure a planar heating of the coal/coke charge from top to bottom. It is thereby possible to shorten the operating time required for a complete carbonization of the coal charge and to increase economic efficiency. Nevertheless, present solutions just represent an approximation to a planar heating because primary air in the upper oven and secondary air in the lower oven can always be supplied only spot-wise via the oven ground area.

An example for the refractory build-up in the lower oven is presented in the top view shown in FIG. 1. The crude gas/waste gas mixture formed in the combustion chamber of the upper oven is supplied to the sole flues in the lower oven in 2 to 20 downcomer channels per oven. There it is completely burnt by addition of combustion air. The heat generated there serves for carbonization of the coal charge from the bottom, thus ensuring a shortened operating time and a high performance rate of the oven. To this effect, so-called secondary air is sucked through openings at the front side in the lower oven and rendered available via a ramified vertical channel system to the actual sole channel heating flues for secondary combustion of combustible gases. During this process, a multitude of short individual flames is created in the sole channels. The heat generated in these sole channel heating flues is then vertically supplied via heat conduction through the oven sole of the coal charge for carbonization of this coal charge. The illustration clearly shows that the multiple-channel setup of the lower oven hardly offers any possibility for increasing the number of secondary air stages and thus for raising the efficiency of secondary combustion. Such a solution would also entail an unreasonably high extra expenditure on calibration procedures in terms of process technology.

Moreover, in the sense of an environmentally friendly oven operation, it is required to reduce nitric oxide ($NO_x$) emissions from an industrial plant to the greatest possible extent. Nitric oxides occur in processes of combustion of fossil fuels, e.g. coal, in the flame and in the surrounding high-temperature zone by a partial oxidation of the molecular nitrogen of combustion air as well as of the nitrogen bound chemically in the fuel. Thermally formed NO as the main $NO_x$ constituent develops from molecular nitrogen $N_2$ in the flame by oxidation with molecular oxygen at temperatures>1300° C. Since temperatures of up to approx. 1450° C. may occur in a NR/HR oven, technical efforts are to be taken to reduce this thermal NO formation and thus the resultant ecological burden. The most significant theoretical possibilities for NO reduction are comprehensively outlined in the following illustration:

low air figure in total
arrangement of air stages
$NH_3$ injection
steam/water injection
waste gas recirculation.

SUMMARY OF THE INVENTION

To solve these two sets of problems outlined hereinabove efficiently and jointly, it is proposed to apply waste gas recirculation in the combustion chambers of the NR/HR oven. The invention accomplishes this task as described herein, and as further elucidated in the drawings FIG. 1 to FIG. 5.

$$\Delta p_{Index2-Index1} = g * \left( \frac{\overline{p}_2}{\overline{T}_2} - \frac{\overline{p}_1}{\overline{T}_1} \right)$$

This measure causes retardation in secondary combustion, it prolongs the individual flames in the sole flue and it promotes homogenization of the burn-off characteristics as well as the release of heat in the lower oven. Moreover, by way of this measure, the oxygen partial pressure in the sole channel heating flues of the lower oven is decreased, which results in a reduction of the thermally formed $NO_x$ waste gas portion. The reason is that due to the admixture of waste gas the temperature of media and thus the thermal NO formation in the sole channel is reduced.

However, it is also possible to withdraw the waste gas only in the further run of the flow, i.e. externally from the channel system of the oven and to return it via a blower of the oven chamber to the downcomers or to the sole channel system in the lower oven. In an intermediate process technology treatment stage, further constituents affecting the environment or process can be deprived from the waste gas before they are returned into the oven.

DETAILED DESCRIPTION OF THE PREFERRED EMBODIMENTS

On the one hand, an internal waste gas recirculation in the sole channel system of the lower oven can be applied. Accordingly, a partial waste gas stream is branched-off immediately prior to its final evacuation from the oven in the sole channel and returned via a channel system or via one or several aperture(s) upstream into the sole channel. The drive for the waste gas recirculation is given by the pressure difference between the sole channels located upstream and downstream which causes a recirculation into the channel located upstream. The pressure difference is attributable to the higher waste gas temperature and thus to the lower density in the sole channel located upstream.

Figure 1A:
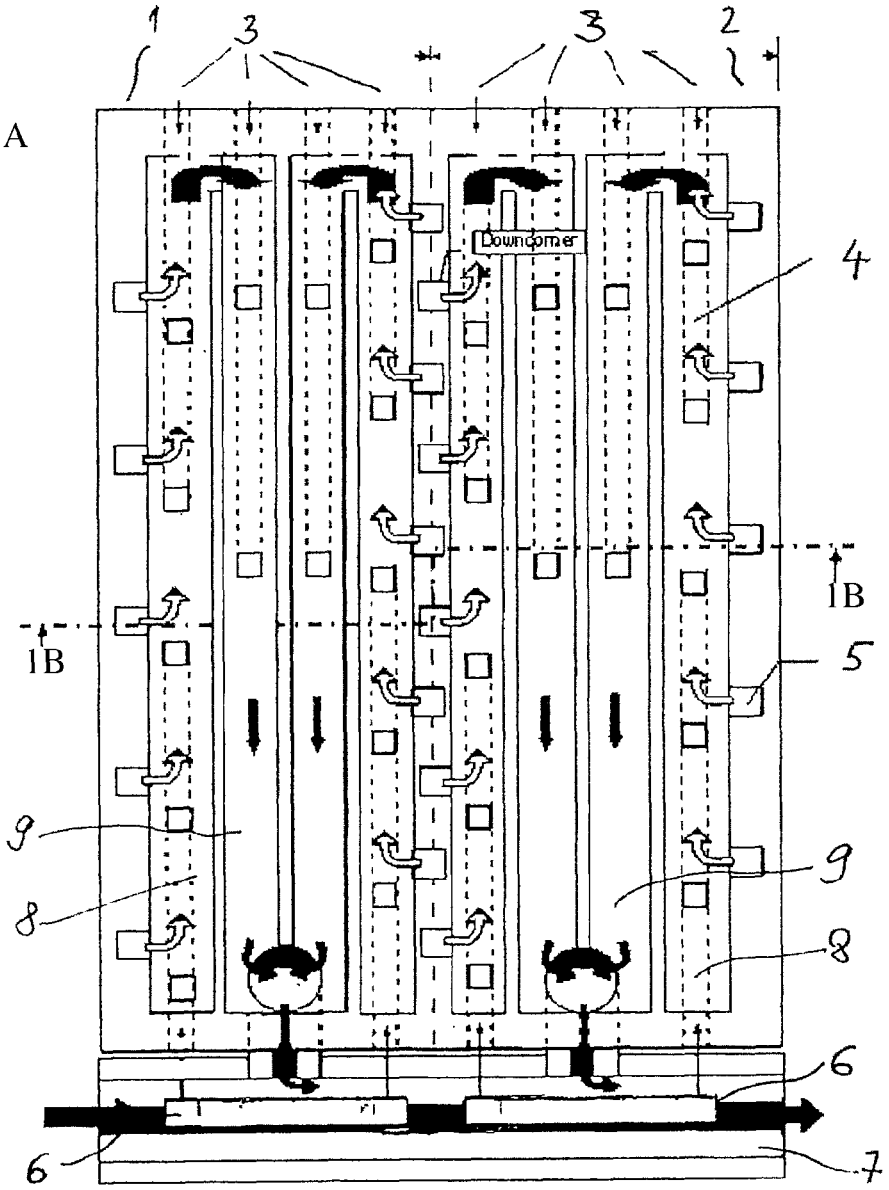
FIGS. 1A and 1B illustrate a sole system of 2 coke ovens arranged next to one another as well as the gas streams, FIG. 1B being a sectional view across 1B-1B of FIG. 1A.
Figure 1B:
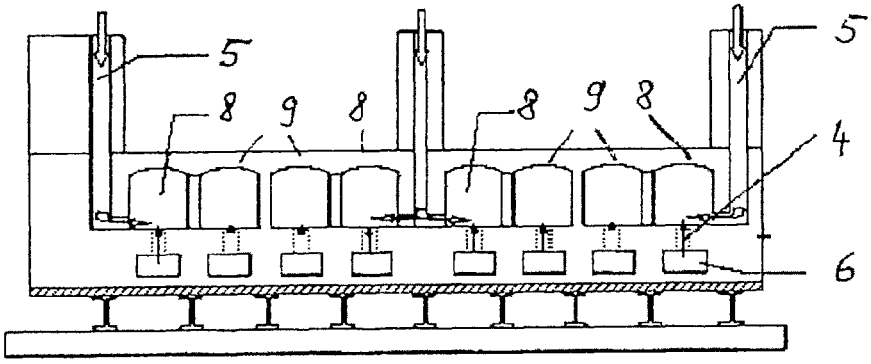

FIG. 1 in a top view and front view shows 2 NR/HR ovens 1 and 2 arranged next to one another, secondary air inlets 3, secondary air outlets 4, and downcomers 5. Furthermore, secondary air channels 6 are integrated in the bottom floor as well as the waste gas channel 7, the inner sole channels 8, and the outer sole channels 9.

Figure 2A:
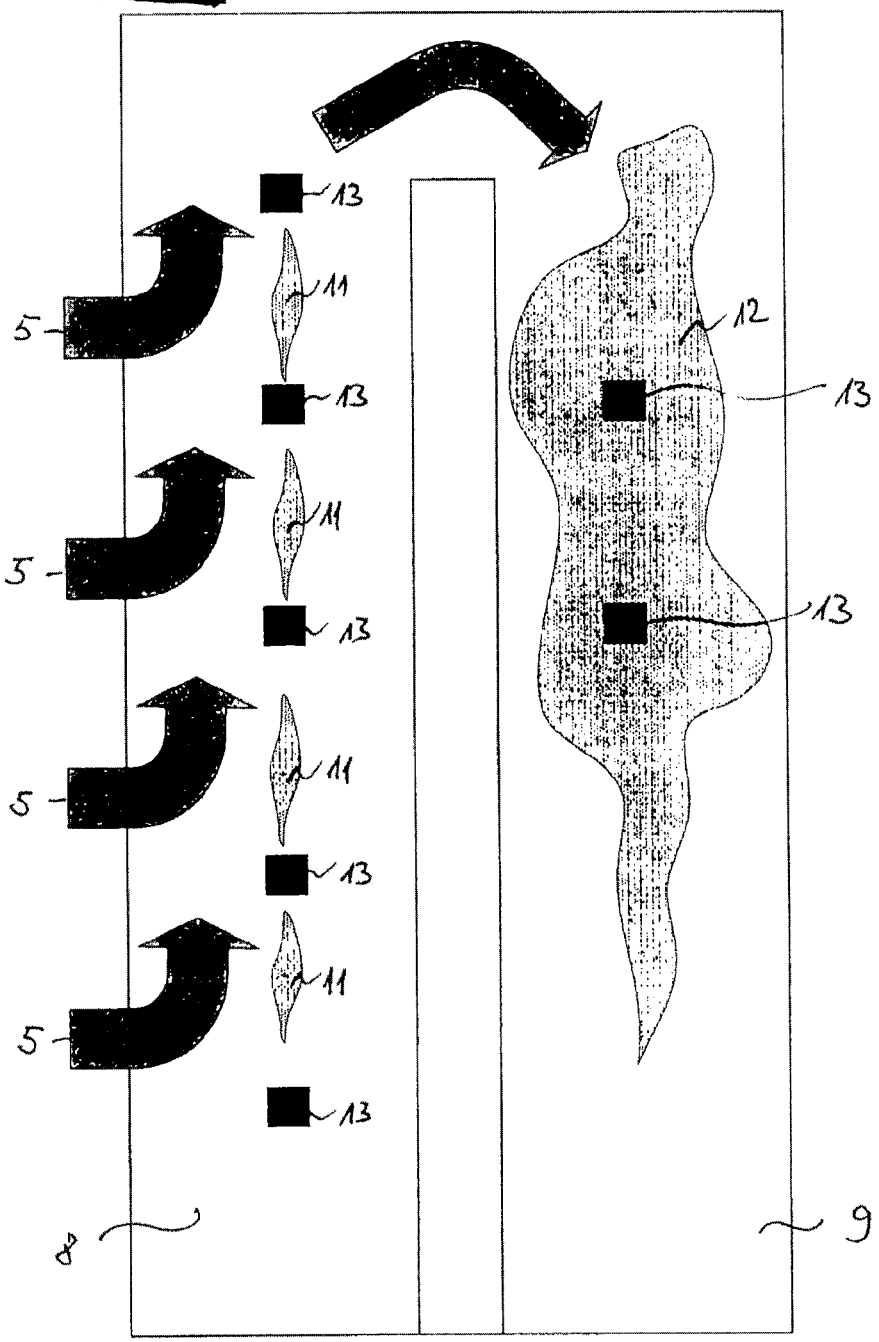
Prior Art Fig 2a
FIG. 2*a* and FIG. 2*b* show the stream routes and the flame formation in the sole channels according to prior art in technology and in comparison therewith the same according to the present invention.

FIG. 2*a* shows the stream routes and the flame formation in the sole channels according to the prior art. Here, the crude gas—waste gas mixture of the upper oven comes from the downcomers 5 and is burnt in flames 11 and 12 with the air from the secondary air outlets 13 in the sole channels 8 and 9.

Figure 2B:
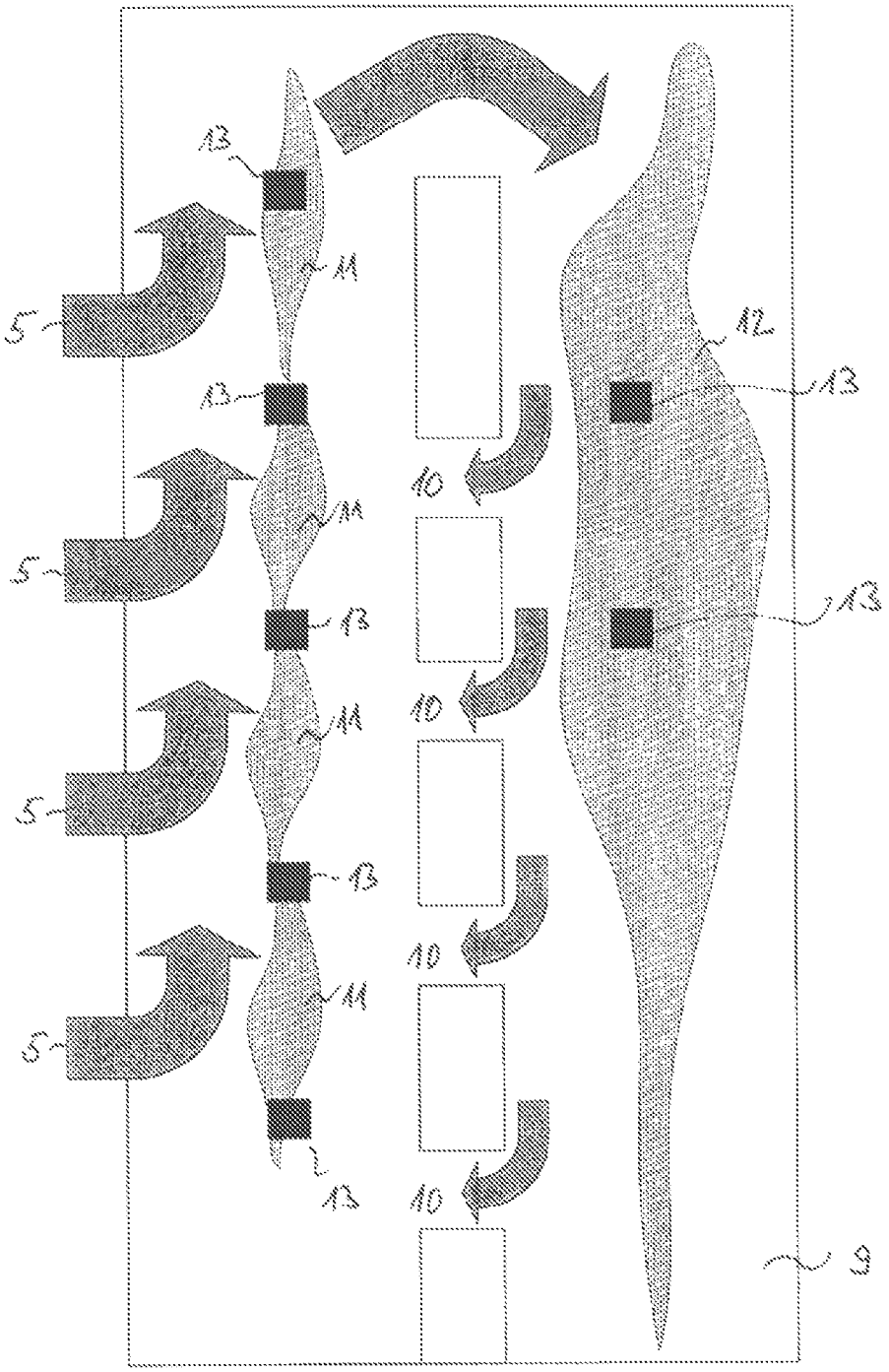

As compared therewith, by applying the inventive method and the corresponding device shown in FIG. 2*b*, individual circular flow apertures 10 are provided for which enable a backflow of waste gas, thus improving the geometry of flames 11 and 12 and achieving the inventive advantages relative to the formation of contaminants.

Figure 3:
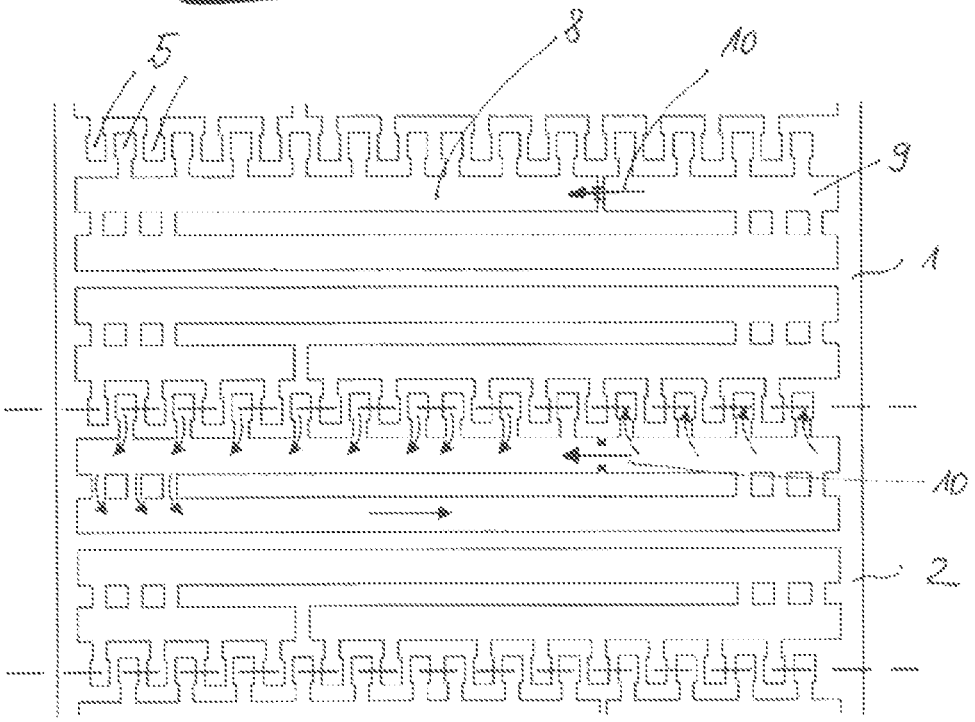
FIG. 3 shows another top view on the sole system of 2 coke ovens arranged next to one another; FIG: 4 shows another top view on the sole system of 2 coke ovens arranged next to one another.

FIG. 3 shows an example for sole channel geometry with an individual aperture 10 to generate an internal waste gas recirculation in the lower oven.

Figure 4:
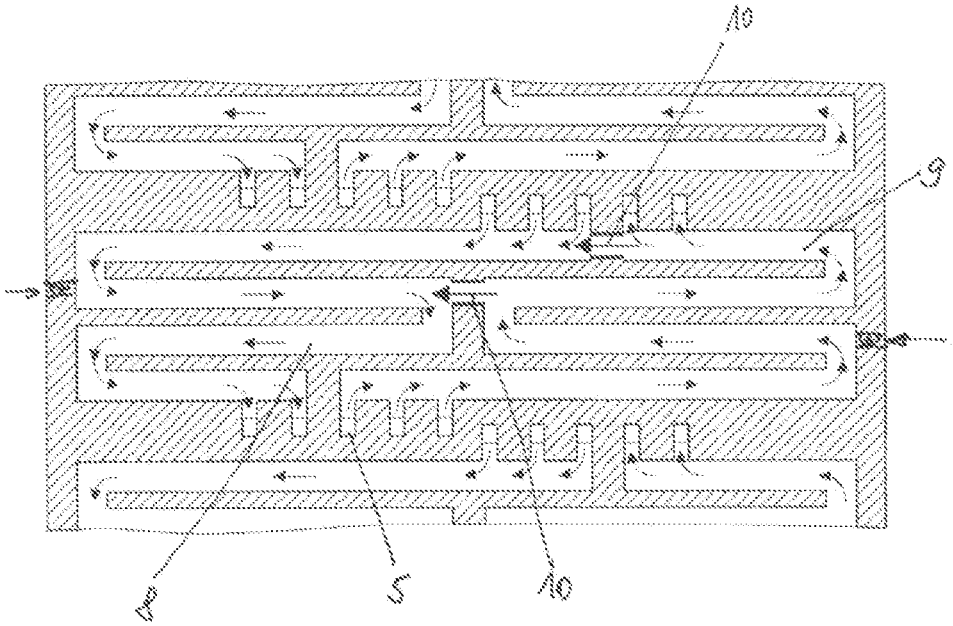

FIG. 4 gives an example for sole channel geometry with two individual apertures 10 to generate an internal waste gas recirculation in the lower oven.

Figure 5:
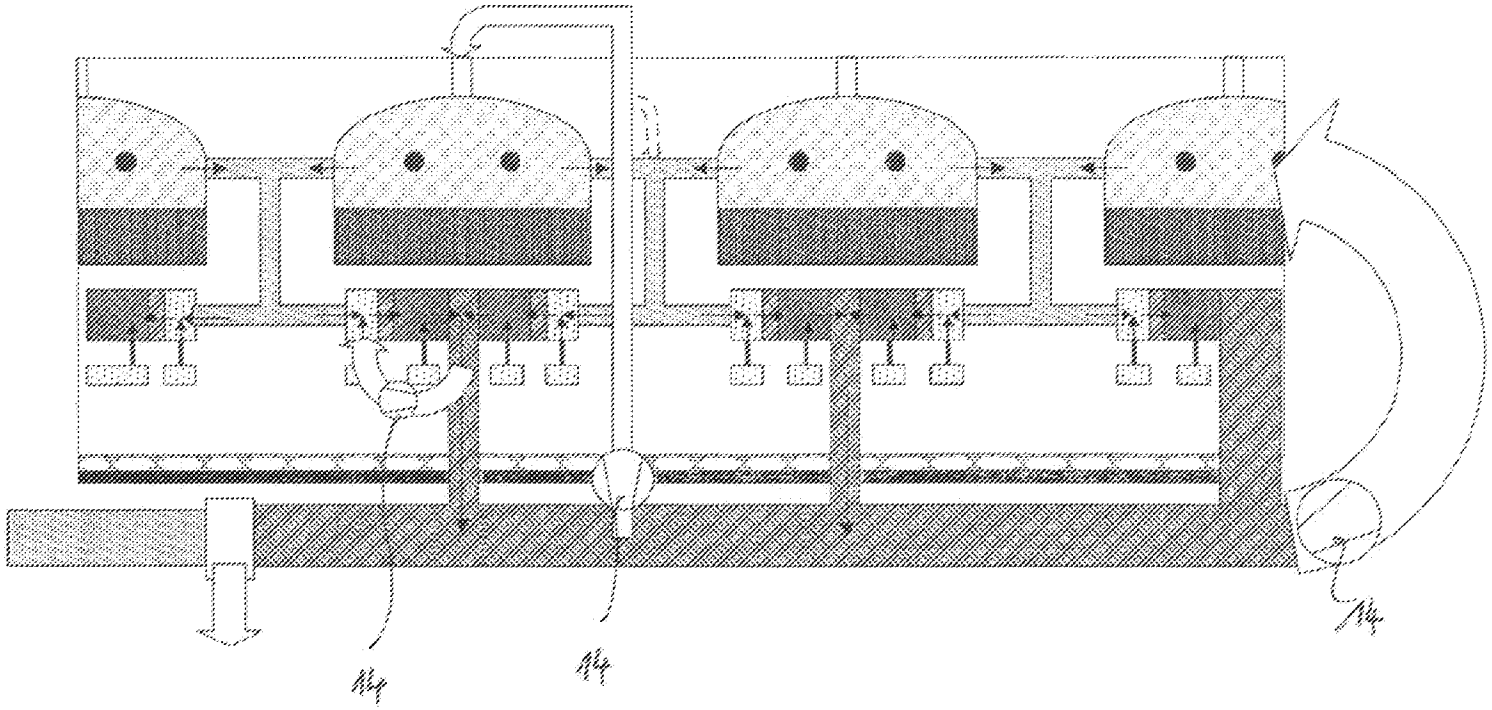
FIG. 5 shows another front view on the sole system of 2 coke ovens arranged next to one another.

FIG. 5 gives two examples for possibilities of an external waste gas recirculation in which blowers 14 each provide for the recirculation.

The invention claimed is:

1. A process for homogenizing burn-out characteristics and for reducing thermal $NO_x$ emissions from a non-recovery or heat-recovery coking plant having a multiplicity of coking furnaces, each coking furnace comprising a coking chamber delimited by oven doors, lateral walls, and an oven top, for a bed of coal or a compacted coal cake, and a lower furnace having a sole channel system of sole channels at least partially integrated below the coking chamber, comprising:

supplying primary combustion air into the coking chamber, transporting partially combusted coking gas from the coking chamber by means of downcomers to sole channel heating flues; supplying secondary air to the sole channel heating flues, further combusting the partially combusted coking gas with secondary air, forming a waste gas stream exiting the coking furnace into an external channel system; and recirculating the waste gas by means of a blower from the external channel system to at least one of the coking chamber, the downcomers, or the sole channel system.

2. The process of claim 1, wherein waste gas is recirculated into the sole channel system.

3. The process of claim 1, wherein waste gas is recirculated into downcomers.

4. The process of claim 1, wherein waste gas is recirculated into primary air apertures in an oven door.

5. The process of claim 1, wherein waste gas is recirculated into primary air apertures in the oven top.

6. A non-recovery or heat-recovery coking plant, comprising a multiplicity of coking furnaces, each coking furnace comprising a coking chamber delimited by oven doors, lateral walls, and an oventop for a bed of coal or compacted coal cake, a lower furnace having a sole channel system of sole channels at least partially integrated below the coking chamber, a plurality of downcomers to transport partially combusted coking gas from the coking chamber to the sole channel system, wherein a plurality of apertures are provided in sole channel partition walls between sole channels such that waste gas produced by further combusting partially combusted coking gas with secondary air is recirculated within the sole channel system, the apertures being closeable or adjustable, and further comprising a blower which recirculates waste gas from the coking plant into one or more of the coking chamber, the downcomers, or the sole channel system.

* * * * *